US005711358A

United States Patent [19]

Willis

[11] Patent Number: 5,711,358

[45] Date of Patent: Jan. 27, 1998

[54] METHOD AND APPARATUS FOR MAKING VERTICAL GRAIN WOOD STRANDS

[76] Inventor: Bobby G. Willis, 2420 York St., Eugene, Oreg. 97404

[21] Appl. No.: 578,133

[22] Filed: Dec. 26, 1995

[51] Int. Cl.[6] ..... B27M 1/08; B27L 5/00; B27C 1/00

[52] U.S. Cl. ..... 144/367; 144/3.1; 144/209.1; 144/215; 144/365; 144/368; 144/369; 428/106

[58] Field of Search ..... 144/1.1, 2.1, 3.1, 144/209.1, 211, 213, 215, 365, 367, 368, 369

[56] References Cited

U.S. PATENT DOCUMENTS

| | | | |
|---|---|---|---|
| 239,903 | 4/1881 | Wilson | 144/166 |
| 523,576 | 7/1894 | Hutchinson | 144/215 |
| 2,314,102 | 3/1943 | Poole | 144/215 |
| 3,993,231 | 11/1976 | Monteiro et al. | 144/215 |
| 5,215,135 | 6/1993 | Coakley et al. | 144/365 |
| 5,215,235 | 6/1993 | Corkley et al. | 144/365 |
| 5,255,726 | 10/1993 | Hasegawa et al. | 144/215 |
| 5,419,381 | 5/1995 | Fisher | 144/365 |

*Primary Examiner*—W. Donald Bray
*Attorney, Agent, or Firm*—Olson & Olson

[57] ABSTRACT

A veneer lathe is provided with back-up rolls modified to include serrating knives to effect cutting a log longitudinally at predetermined circumferentially spaced apart intervals to define the width of wood strands, and also to include scribing cutters to effect cutting a log circumferentially at longitudinally spaced apart intervals to define the length of wood strands, whereby when the log is rotated past the peeler knife of the lathe, the thickness of wood peeled from the log breaks apart into a multiplicity of vertical grain strands of predetermined length, width and thickness.

19 Claims, 4 Drawing Sheets

METHOD AND APPARATUS FOR MAKING VERTICAL GRAIN WOOD STRANDS

BACKGROUND OF THE INVENTION

This invention relates to wood strand material for use in making lumber products, and more particularly to the method and apparatus for making vertical grain strand material.

Wood strand material has been produced heretofore. In one popular method, logs are sliced by a knife edge disposed parallel to the longitudinal axis of the log and moved through the log on a chord from the outer circumferential surface. These slices are characterized by wood grain which varies from nearly vertical at the log surface to cross grain at the center. Accordingly, the strength characteristic of the slices varies significantly through their depth. The slices are of fixed length, random width and poor thickness control. They then are broken up to achieve an approximate ten-to-one ratio of length-to-width, and the broken strands then are laid up for hot pressed consolidation with glue to produce oriented strand board.

In another prior art method, waste veneer from conventional plywood production is chopped up to produce vertical grain strands of fixed width, random length and plywood veneer thickness of about 0.1 inch. These relatively thick strands are laid up in parallel arrangement and hot pressed with glue to produce a board or beam product characterized by many voids which fill with glue. This contributes adversely to lower strength, quality and appearance.

SUMMARY OF THE INVENTION

This invention produces wood strands of uniform length, width, thickness and uniform vertical grain by scoring the peripheral surface of a log both lengthwise and circumferentially as the log is rotated in a lathe and a thickness is peeled from the log.

The principal objective of this invention is to provide a method and apparatus for making wood strands that overcomes the aforementioned limitations and disadvantages of prior methods and apparatus.

Another objective of this invention is the provision of method and apparatus for making wood strands which is achieved by operation of a modified form of veneer lathe.

Still another object of this invention is the provision of method and apparatus for making wood strands which are entirely of vertical grain configuration.

A further objective of this invention is to provide method and apparatus for the economical mass production of wood strands.

A still further objective of this invention is the provision of method and apparatus for making vertical grain wood strands of predetermined and reproducible uniform geometrical dimensions.

The foregoing and other objects and advantages of this invention will appear from the following detailed description, taken in connection with the accompanying drawings of a preferred embodiment.

DESCRIPTION OF THE PREFERRED EMBODIMENT

Figure 1:
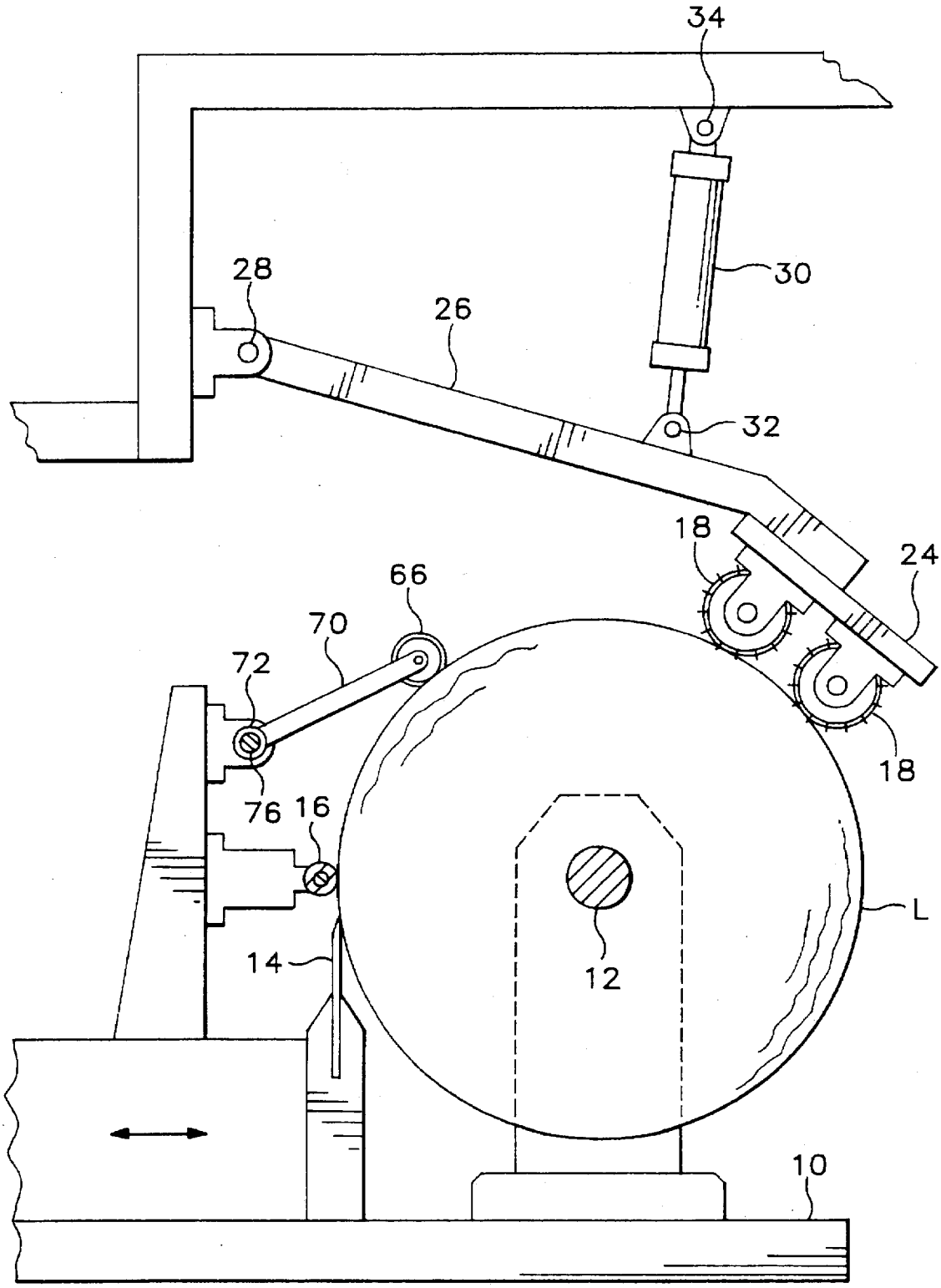
FIG. 1 is a fragmentary schematic side view of apparatus for making wood strands and embodying the features of this invention.

Referring primarily to FIG. 1 of the drawings, there is shown schematically a veneer lathe frame 10 supporting a spindle assembly 12 which in turn supports a log L for axial rotation relative to the length of a peeler knife 14 with power driven nose bar 16. Associated with the veneer lathe, in the position normally occupied by conventional power driven back-up rolls, is an assembly of power driven serrating rolls 18 for creasing or cutting the surface of a log in the longitudinal direction of the log to define the width of wood strands to be produced.

Figure 2:
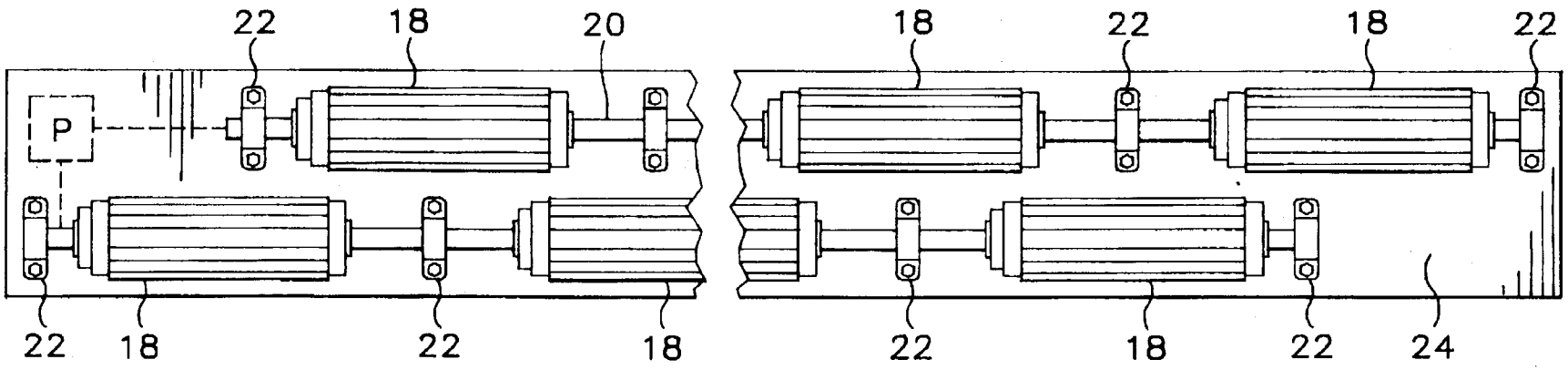
FIG. 2 is a plan view of the serrating roller component of the apparatus of FIG. 1.

As best shown in FIG. 2 of the drawings, the serrating roll assembly includes a plurality of serrating rolls 18 secured for rotation with a pair of power driven shafts 20 disposed parallel to each other and journaled in stand-off bearings 22 secured to plate 24. The power drive for the rolls 18, shown schematically in broken lines in FIG. 2, is synchronized with the spindle drive for simultaneous and equal rotation relative to the circumference of the log. The plate is mounted on one end of an elongated swing arm 26 (FIG. 1) the opposite end of which is supported by pivot 28 mounted on the lathe frame 10. An hydraulic piston-cylinder unit 30 is connected at one end by pivot 32 to the swing arm 26 and at the opposite end by pivot 34 to the lathe frame 10.

Figure 3:
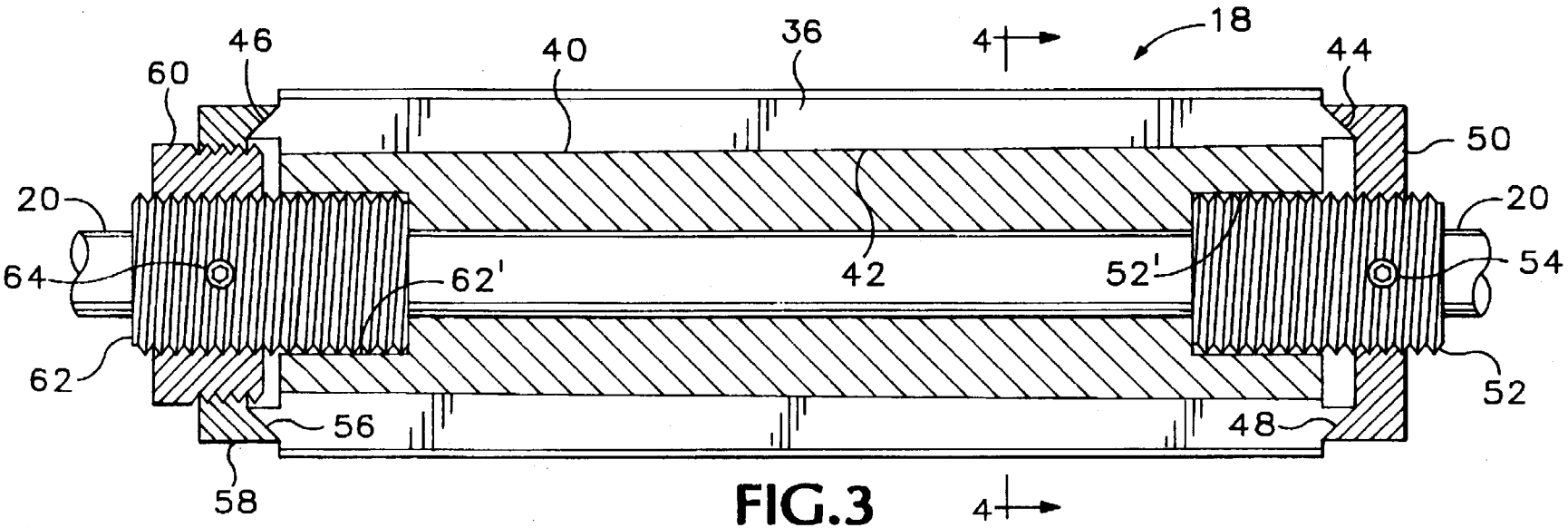
FIG. 3 is a fragmentary longitudinal section of one of the serrating rolls of FIG. 2.
Figure 4:
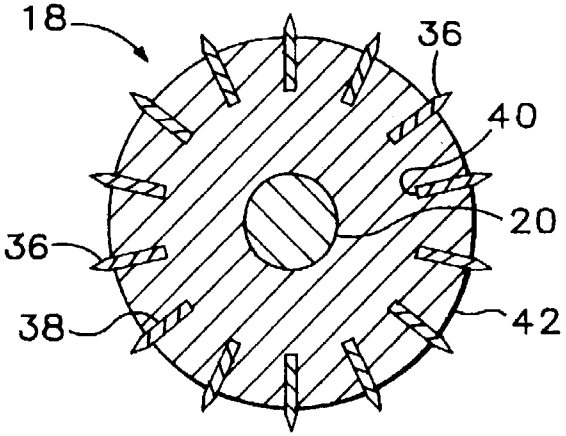
FIG. 4 is a sectional view taken on the line 4—4 in FIG. 3.

As best illustrated in FIGS. 3 and 4 of the drawings, each serrating roll 18 includes a plurality of elongated serrating knives 36 contained freely in milled slots 38 spaced apart circumferentially about the roll 18. The inner side 40 of the slots 38 tapers from one diameter at one end (the left end in FIG. 3) to a larger diameter at the opposite end. Each serrating knife is correspondingly tapered along its inner edge 42, and the opposite ends of the knife are provided with longitudinally outward and radially inward projecting tapers 4 and 46. The end tapers 44 are disposed for cooperative association with the internal annular taper 48 on end stop 50 which is in threaded engagement with threaded sleeve 52. The sleeve is secured releasably secured to the support shaft 20 by set screw 54. An internal recess 52' within the roll 18 retractably receives the sleeve 52, for purposes described more fully hereinafter.

In similar manner, the internal annular taper 56 on end stop 58 is arranged for cooperative association with the taper 46 on the end of the knives 36 opposite the taper 44. The end stop 58 is threaded to a threaded collar 60 which in turn is threaded to sleeve 62 secured to the shaft 20 by set screw 64. The corresponding end of the roll 18 is provided with a recess 62' for retractable reception of the sleeve 62, for the purpose described hereinafter.

When it is desired to move the cutting edges of the serrating knives 36 radially outward, as when the edges have been sharpened and hence reduced in height, the end stop 50 is rotated to move it longitudinally away from the tapers 44, and then stop 58 is rotated to move it toward stop 50. Stop 58 thus moves the knives 36 toward stop 50, whereupon the knives move along the tapered surfaces 40 of the milled slots 38 and move the knife edges radially outward to a new cutting setting.

Figure 5:
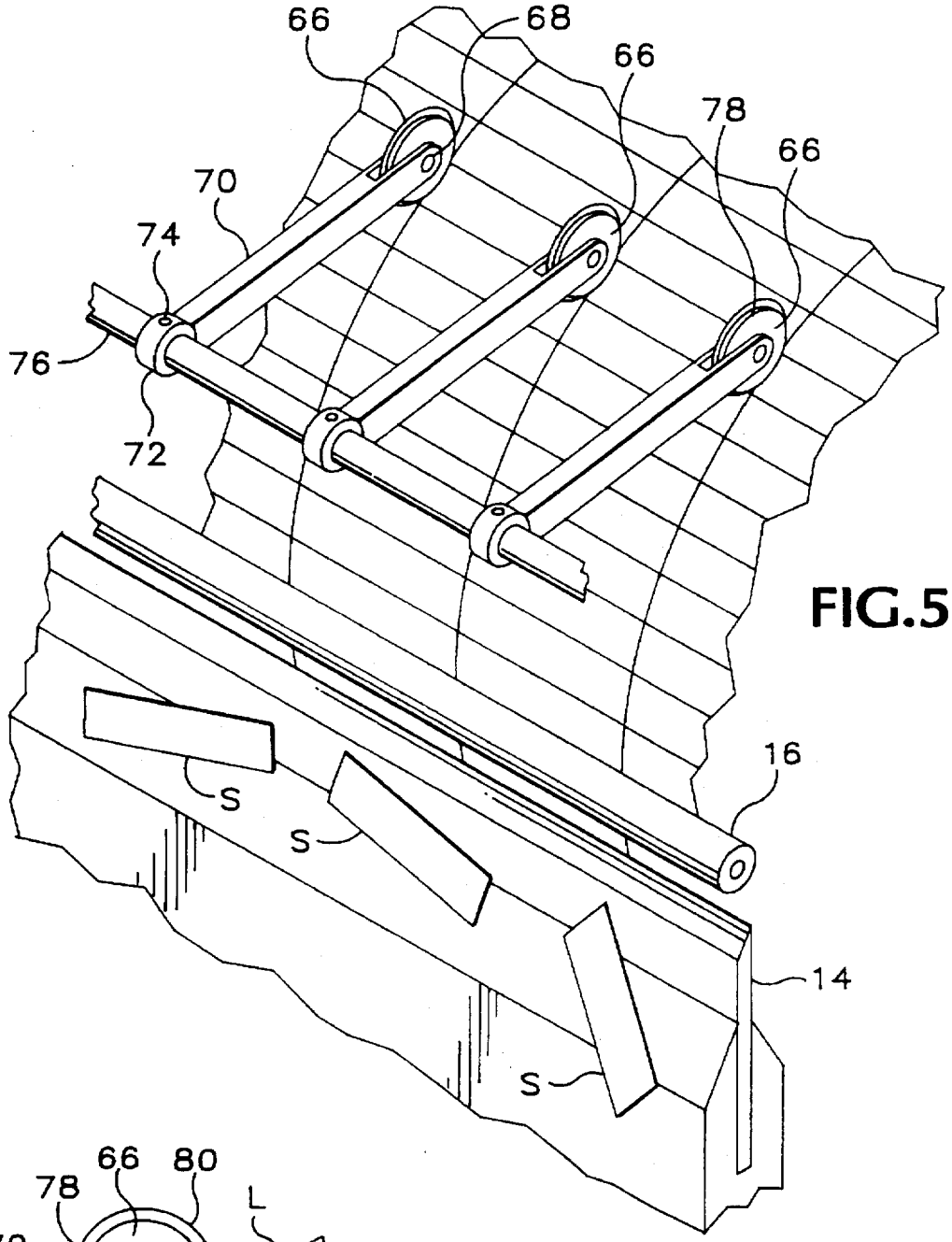
FIG. 5 is a fragmentary perspective view of the scribing cutter component of the apparatus of FIG. 1.
Figure 6:
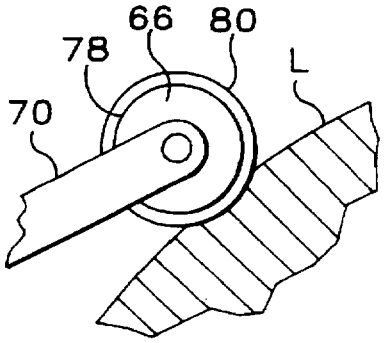
FIG. 6 is a fragmentary side elevation, on an enlarged scale, of one of the scribing cutters of FIG. 5.

Referring now to FIG. 5 of the drawings there is shown a plurality of circular scribing cutters 66 each mounted on an axle 68 at the outer end of an elongated resilient arm 70. The inner end of the arm is attached to a collar 72 which is secured releasably by set screw 74 to an elongated shaft 76. The shaft is positioned adjacent and parallel to the nose bar 16 and is supported on the lathe frame 10 for simultaneous adjustment with the lathe knife and nose bar (FIG. 1). The cutter is provided with a flat circular depth gauge surface 78 (FIGS. 5, 6) radially inward of the cutting edge 80 to limit the penetration of the cutting edge into wood.

Figure 7:
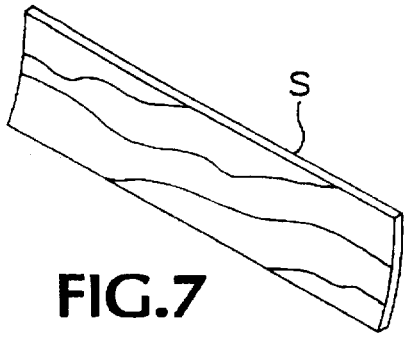
FIG. 7 is a perspective view of a wood strand produced by operation of the apparatus of FIG. 1.

The operation of the apparatus described hereinbefore is as follows: A log L is delivered to the veneer lathe and secured thereto at its opposite ends by the drive spindles 12 which effect rotation of the log. The log is rotated and the peeler knife 14, nose bar 16, serrating rolls 18 and scribing cutters 66 are moved into contact with the log, first removing the outer irregular portion of the log to bring the latter to a round shape. The strands removed from this area of the log may be of random length, but of predetermined width and thickness. Thereafter, the serrating knives 36 engage the periphery of the rounded log over its entire length to effect cutting the surface of the log longitudinally, substantially to the depth to which the peeler knife 14 is set, to define the width of the strands S (FIG. 7).

As the log rotates further toward the peeler knife 14, the cutting edges 80 of the scribing cutters 66 cut the log at the longitudinal positions of the confronting ends of adjacent serrating knives 36, and also midway between the ends of the serrating knives on each supporting roll 18. Thus, if the knives are 12 inches long, as illustrated for the 8 foot length of log L, the strands will be 6 inches in length.

The scribing cutters 66 may be spaced apart to different distances to produce strands of any desired length. It is desired that the strands be 2–12 inches in length, preferably about 6 inches. Also, the serrating knives 36 may be spaced apart on the roll 18 to any desired distance, by using different rolls with milled slots 38 spaced part to various widths, to produce strands of any desired width. Thus, although strand width of about 0.5 inch is preferred, the width may be varied between 0.25 and 1.0 inch, as desired.

As the log rotates further, after being cut longitudinally and circumferentially by the serrating and scribing cutters, respectively, it is cut to a predetermined depth set by the peeler knife 14. This depth may range between 0.010 and 0.040 inch, preferably about 0.020 inch. A thickness of wood thus is peeled from the entire length of the log, and as it leaves the peeler knife it falls apart along the lines cut by the serrating and scribing cutters, to produce a multiplicity of vertical grain wood strands S of predetermined length, width and thickness. The strands also are characterized by being flat, without significant twist or curl.

While some of the strands may break apart along their length, parallel to the direction of the vertical grain in the wood, thereby producing strands of variable width, the length and thickness are not altered. Accordingly, the strands may be assembled, as on caul plates, either in random disposition or all parallel to each other, or mixed. Since the strands are flat and devoid of twist and curl, they assemble in compact configuration in readiness for consolidation with bonding resin in a hot press to produce a desired end product. This end product may be dimensioned lumber, beams, or other form of product, and is characterized by having the highest quality vertical grain configuration.

It will be apparent to those skilled in the art that various changes may be made in the size, shape, type, number and arrangement of parts of the apparatus described hereinbefore and in the method steps disclosed. For example, the log may be subjected to the cutting action of the scribing cutters before the serrating knives, rather than the reverse as illustrated. The scribing cutters and serrating knives may cut the wood to a depth slightly more than the thickness of wood peeled by the peeler knife, so that the cuts allow the peeled thickness to fall apart clearly along the cut lines of the serrating and scribing cutters. The strength characteristics of the strands vary with the length of the wood fibers in diverse species of wood, and the strength and density characteristics of products produced by the hot press resin consolidation of the strands vary with the wood species, type of bonding resin and consolidation pressure. These and other changes may be made without departing from the spirit of this invention and the scope of the appended claims.

I claim:

1. The method of making vertical grain wood strands from wood logs, comprising:

a) rotating a log on its longitudinal axis, b) subjecting the rotating log to the cutting action of a plurality of cutters to effect cutting the log longitudinally at circumferentially spaced apart positions of between 0.25 and 1.0 inch and circumferentially at longitudinally spaced apart positions of between 2 and 12 inches to define the width and length, respectively of wood strands, and c) subjecting the rotating log to the cutting action of a peeler knife to effect cutting the log to a predetermined depth of between 0.01 and 0.04 inch to define the thickness of wood strands.

2. The method of making vertical grain wood strands from wood logs, comprising:

a) rotating a log on its longitudinal axis, b) subjecting the rotating log to the cutting action of a plurality of serrating cutters to effect cutting the log longitudinally at circumferentially spaced apart positions of between 0.25 and 1.0 inch to define the width of wood strands, c) subjecting the rotating log to the cutting action of a plurality of scribing cutters to effect cutting the log circumferentially at longitudinally spaced apart positions of between 2 and 12 inches to define the length of wood strands, and d) subjecting the rotating log to the cutting action of a peeler knife to effect cutting the log to a predetermined depth of between 0.01 and 0.04 inch to define the thickness of wood strands.

3. Apparatus for making vertical grain wood strands from wood logs, comprising:

a) a lathe arranged to support and rotate a log on its longitudinal axis, b) a plurality of serrating cutters mounted for movement toward and away from a log supported on the lathe and arranged to cut a rotating log longitudinally at circumferentially spaced apart positions of between 0.25 and 1.0 inch to define the width of wood strands, c) a plurality of scribing cutters mounted for movement toward and away from a log supported on the lathe and arranged to cut a rotating log circumferentially at longitudinally spaced positions of between 2 and 12 inches to define the length of wood strands, and d) a peeler knife arranged to cut a rotating log along the length of the log to a predetermined depth of between 0.01 and 0.04 inch to define the thickness of wood strands.

4. The apparatus of claim 3 wherein the serrating cutters are arranged to serve as back-up rolls positioned on the side of a log opposite the peeler knife.

5. The apparatus of claim 3 wherein the grooves in the cutters include an elongated cylindrical roll, a plurality of longitudinal grooves in the roll spaced apart circumferentially around the roll, an elongated serrating cutter knife in each groove secured releasably to the roll, and a shaft mounting the roll for rotation.

6. The apparatus of claim 5 wherein the groove in the cylindrical roll taper longitudinally from one diameter at one end to a larger diameter at the opposite end, the cutter knives have an outer cutting edge and an inner base edge engaging the bottoms of the grooves, the cutter knives tapering longitudinally from one width at one end to a larger width at the opposite end, the cutter knives being mounted in the grooves with the larger width end disposed at the said one diameter end of the roll, and stop means on the shaft adjacent the ends of the roll releasably engaging the opposite ends of the knives, the stop means movable in the longitudinal direction of the roll for moving the knives longitudinally relative to the roll for moving the cutting edges of the knives radially relative to the roll.

7. The apparatus of claim 6 wherein the opposite ends of the cutter knives taper longitudinally outward and radially inward toward the base edges thereof, and the stop means include collars threaded to sleeves secured to the shaft and having tapered recesses matching the tapered ends of the knives, for retaining said tapered ends therein.

8. The apparatus of claim 3 wherein the scribing cutters include circular cutting edges and each cutter is mounted rotatably on the outer end of an elongated arm, and an elongated support shaft mounting the inner ends of the plurality of arms in longitudinally spaced relation defining the length of wood strands.

9. The apparatus of claim 8 wherein each scribing cutter has a flat circular surface radially inward of the cutting edge thereof to provide a depth gauge limiting the depth of cutting by the cutting edge.

10. A vertical grain wood strand of predetermined thickness defined by the thickness of a layer of wood peeled from the circumference of a log and ranging between 0.01 and 0.04 inch, the strand having a predetermined length defined by cut lines in the peeled layer spaced apart between 2 and 12 inches in the longitudinal direction of the wood fiber in the layer, the strand having a predetermined width defined by cut lines in the peeled layer spaced apart between 0.25 and 1.0 inch in the transverse direction of the wood fiber in the layer.

11. The vertical grain wood strand of claim 10 wherein the thickness of the strand is about 0.020 inch, the length of the strand is about 6 inches, and the width of the strand is about 0.5 inch.

12. The method of making a lumber product, comprising:

a) providing a multiplicity of vertical grain wood strands having a length of between 2 and 12 inches, a width of between 0.25 and 1.0 inch and a thickness of between 0.01 and 0.04 inch, b) mixing bonding resin with the strands, c) arranging the mixture of strands and bonding resin in the form of a lumber product, and d) consolidating the formed mixture under elevated temperature and pressure.

13. The method of claim 12 wherein the strands have a length of about 6 inches, a width of about 0.5 inch and a thickness of about 0.02 inch.

14. The method of claim 12 wherein the multiplicity of strands are arranged with their lengths disposed substantially parallel to the longitudinal dimension of the lumber product.

15. The method of claim 12 wherein the multiplicity of strands are arranged with their lengths disposed at random angles relative to the longitudinal dimension of the lumber product.

16. A lumber product consisting of a consolidated mixture of bonding resin and a multiplicity of vertical grain wood strands having a length of between 2 and 12 inches, a width of between 0.25 and 1.0 inch and a thickness of between 0.01 and 0.04 inch.

17. The lumber product of claim 16 wherein the strands have a length of about 6 inches, a width of about 0.5 inch and a thickness of about 0.02 inch.

18. The lumber product of claim 16 wherein the strands are arranged with their lengths disposed substantially parallel to the longitudinal dimension of the lumber product.

19. The lumber product of claim 16 wherein the strands are arranged with their lengths disposed at random angles relative to the longitudinal dimension of the lumber product.

* * * * *

UNITED STATES PATENT AND TRADEMARK OFFICE
CERTIFICATE OF CORRECTION

PATENT NO. : 5,711,358

DATED : 27 January 1998

INVENTOR(S) : BOBBY G. WILLIS

It is certified that error appears in the above-identified patent and that said Letters Patent is hereby corrected as shown below:

Column 2, line 48, "4" should read: --44--.

Column 5, line 8, "grooves in the" should read: --serrating--.

5, line 14, "groove" should read: --grooves--.

5, line 24, after "means" insert: --being--.

Signed and Sealed this

Seventh Day of April, 1998

Bruce Lehman

*Attest:*

BRUCE LEHMAN

*Attesting Officer*

*Commissioner of Patents and Trademarks*